US005337902A

United States Patent [19]

Evans et al.

[11] Patent Number: 5,337,902

[45] Date of Patent: Aug. 16, 1994

[54] TABLET SENSOR

[75] Inventors: Mark D. Evans, West St. Paul, Minn.; Roger C. Oestreich, River Falls, Wis.

[73] Assignee: Modern Controls, Inc., Minneapolis, Minn.

[21] Appl. No.: 106,413

[22] Filed: Aug. 13, 1993

[51] Int. Cl.[5] ..... B07C 5/02

[52] U.S. Cl. ..... 209/539; 209/525; 209/571; 209/598; 209/919; 324/663

[58] Field of Search ..... 209/571, 572, 539, 919, 209/525, 594, 598; 324/663, 671

[56] References Cited

U.S. PATENT DOCUMENTS 3,633,740 1/1972 Westmoreland .
3,993,194 11/1976 Reuland ..... 209/571 X
4,223,751 9/1980 Ayers et al. .
4,284,947 8/1981 Walton ..... 209/572 X
4,569,445 2/1986 Kovats et al. .
4,860,229 8/1989 Abbe et al. .
5,135,113 8/1992 Mayer et al. .

*Primary Examiner*—Richard A. Schacher
*Attorney, Agent, or Firm*—Palmatier, Sjoquist & Helget

[57] ABSTRACT

An apparatus for measuring the capacitance of tablets of varying shapes and sizes by conveying the tablets along a curved path which includes a zone of travel between the plates of a capacitive sensing device. The tablets are conveyed in a relatively fixed orientation by constructing a guide channel including a fixedly-positioned curved guide spaced away from a rotatable disk, and wherein a resilient clamp is provided above the guide channel so as to compress the tablet against the rotatable disk during its path of travel.

20 Claims, 6 Drawing Sheets

TABLET SENSOR

BACKGROUND OF THE INVENTION

The present invention relates to an apparatus for receiving a stream of tablets in aligned sequence, and for moving the stream of tablets beneath a sensing head to measure a physical parameter of the tablets, and for conveying the tablet stream into two or more paths, depending upon the measured parameter. The invention is preferably usable in connection with a stream of medicinal tablets of the various types and forms made by the pharmaceutical industry.

Pharmaceutical tablets are typically made in a process which involves compressing a powdered mixture in a mold cavity to form a solid tablet construction. After forming, the tablets are sometimes coated with various coating materials, but in some cases the pressed tablets are processed without coating. The manufacturing process produces tablets of uniform size and shape, but the nature of the process inherently leads to a number of broken or partially-formed tablets, or tablet particles, or tablets which do not meet the necessary weight specifications, which must be separated from the correctly formed tablets prior to packaging. Since the tablets are typically manufactured in considerable volumes, the process of inspecting and separating good tablets from bad tablets must necessarily be a relatively high-speed process. The tablets produced by the manufacturing process are typically quite brittle in construction, and therefore the subsequent handling of tablets must be made with some degree of care in order to avoid damaging the completed tablets.

The assignee of the present invention has previously disclosed, in U.S. Pat. No. 5,135,113, issued Aug. 4, 1992, a tablet machine for sorting tablets by capacitive measurement. This patent describes a machine particularly useful for the sorting of tablets having a cylindrical shape, wherein the tablets are guided onto a rotating disk and conveyed between capacitor plates, and including a deflector assembly for deflecting tablets along one of a possible number of paths as a consequence of the capacitance measurement made by the device. The assignee of the present invention has also disclosed, in U.S. patent application Ser. No. 07/947,064, filed Sep. 18, 1992, now U.S. Pat. No. 5,240,118 a tablet sorting machine of the same general type having an apparatus for conveying tablets in uniform alignment and orientation from the peripheral edge of a rotating turntable. The present invention is usable with this form of tablet conveying device, and represents an improvement over the aforementioned patent in that the present device enables the conveying and measurement of tablets of varying shapes and sizes, including nonsymmetrical tablets.

The problem of measuring capacitive parameters of tablets under high-speed conditions requires that the tablets be uniformly and sequentially arranged, and that their alignment relative to the capacitive measuring plates be carefully controlled. When tablets such as circular tablets are measured in this way, the symmetrical design of the tablet requires only that the tablet maintain a uniform position relative to its axis while it is conveyed through the sensing device. The orientation of the tablet need only be controlled so as to maintain the axis of the tablet in a relatively vertical position while the tablet passes between the capacitive measurement plates. The measurement problem becomes compounded when tablets having nonsymmetrical dimensions are provided, for such tablets require uniform positioning along multiple axes while passing between the capacitive measurement plates.

SUMMARY OF THE INVENTION

The apparatus of the present invention includes a rotatable two-level tray, wherein the lower level of the tray is disk-shaped and rotates between the plates of a capacitive measurement device. The upper level of the tray is of lesser diameter than the lower level, and has a predetermined height dimension relative to the lower level. A semicircular guide member is placed above and closely adjacent the lower tray level, with a radius of curvature larger than the upper tray level, and is spaced away from the upper tray level so as to create a guide channel therebetween. A resilient cover member is positioned over the guide channel at a height which is 70%–90% of the height dimension of tablets to be conveyed and measured by the apparatus. Tablets are conveyed in serial stream sequence into the aforementioned channel, and are resiliently held against the lower level as they are conveyed about the rotatable disk adjacent to the semicircular guide member, in fixed orientation, so that the tablets are conveyed between the capacitive measurement plates in said fixed orientation. As tablets emerge from the channel they are selectively deflected to one of a number of possible paths of travel, depending upon the capacitive measurement made by the measurement plates as the tablets pass through the sensor.

It is the principal object and advantage of the present invention to fixedly control the orientation of tablets while conveying them through a measurement sensor.

It is another object and advantage of the present invention to convey a serial sequence of tablets in uniform orientation and direction through a tablet sensor.

Other objects and advantages of the present invention will become apparent from the following specification and claims, and with reference to the appended drawings.

DESCRIPTION OF THE PREFERRED EMBODIMENT

Figure 1:
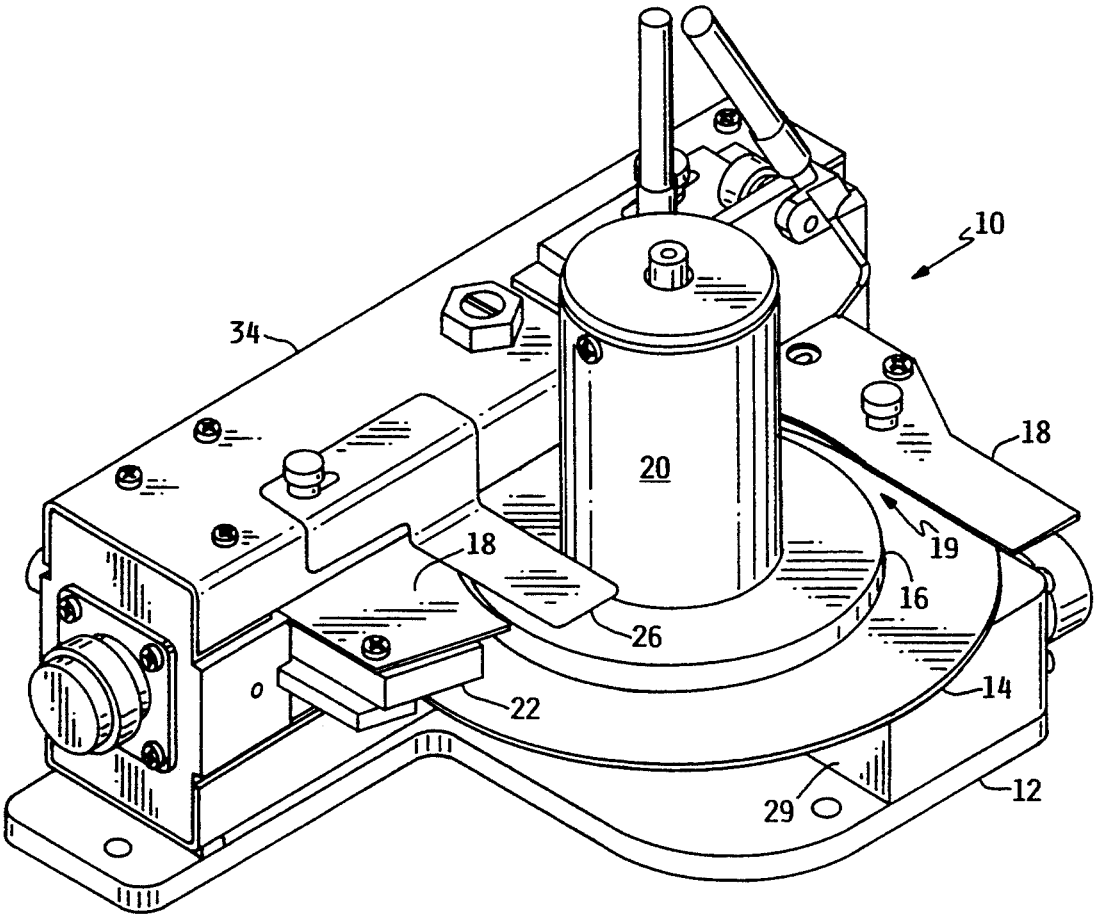
FIG. 1 shows an isometric view of the present invention.
Figure 4:
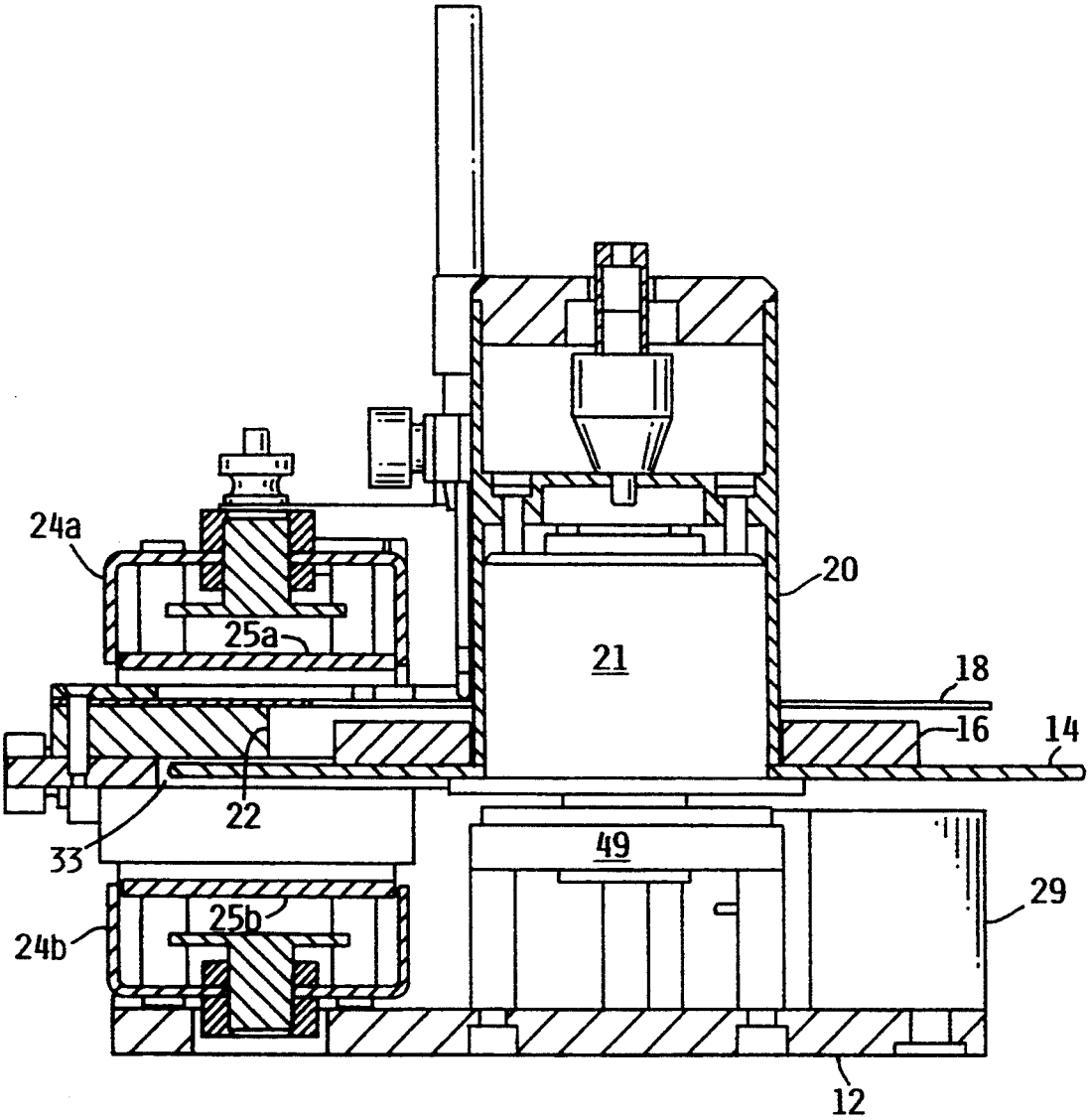
FIG. 4 shows a cross-section view taken along the lines 4—4 of FIG. 2.

FIG. 1 shows an isometric view of tablet measuring machine 10. The machine has a base 12 upon which the various mechanical and electrical components of the invention are affixed. Base 12 supports a frame 49 which supports a drive motor 21 (FIG. 4). Drive motor 21 has a rotatable shaft (not shown) which is affixed to a lower disk 14, so that lower disk 14 is rotatable with the shaft of motor 21. The electrical connections for drive motor 21 are found in electrical connector box 29. Lower disk 14 is preferably constructed of aluminum or other similar metallic material. An upper disk 16 sits atop lower disk 14; disk 16 has a central opening larger than the outside diameter of the motor cover 20 about motor 21. Disk 16 is preferably made from silicone rubber, having sufficient frictional contact with the surface of lower disk 14 so as to rotate therewith. Disk 16 is removable from its position overlaying lower disk 14, and several alternative disks 16 may be constructed, each having differing outer diameters.

Lower disk 14 is mounted so as to at least partially project into an opening 33 within a sensor housing 34 (see FIG. 4). A curved guide member 22 is affixed in this same opening, and has an inner surface spaced a predetermined distance from the outer surface of upper disk 16. A resilient clamp 18 is affixed to the top side of curved guide member 22. Resilient clamp 18 preferably is formed of two layers: a top layer of polystyrene is bonded to a bottom layer of ultra high density polypropylene. Resilient clamp 18 is spaced a predetermined height above lower disk 14, determined by the height dimension of the tablets to be conveyed by the machine. Preferably, resilient clamp 18 is spaced away from the upper surface of lower disk 14 by a distance which is 70%-90% of the height dimension of the tablets to be conveyed by the machine.

A metallic static dissipater 26 is clamped to sensor housing 34, and has an extending tab which is bent downwardly so as to lightly contact the upper surface of upper disk 16. Static dissipater 26 serves to ground upper disk 16 from producing static electrical arcing while the machine is in operation.

Figure 2:
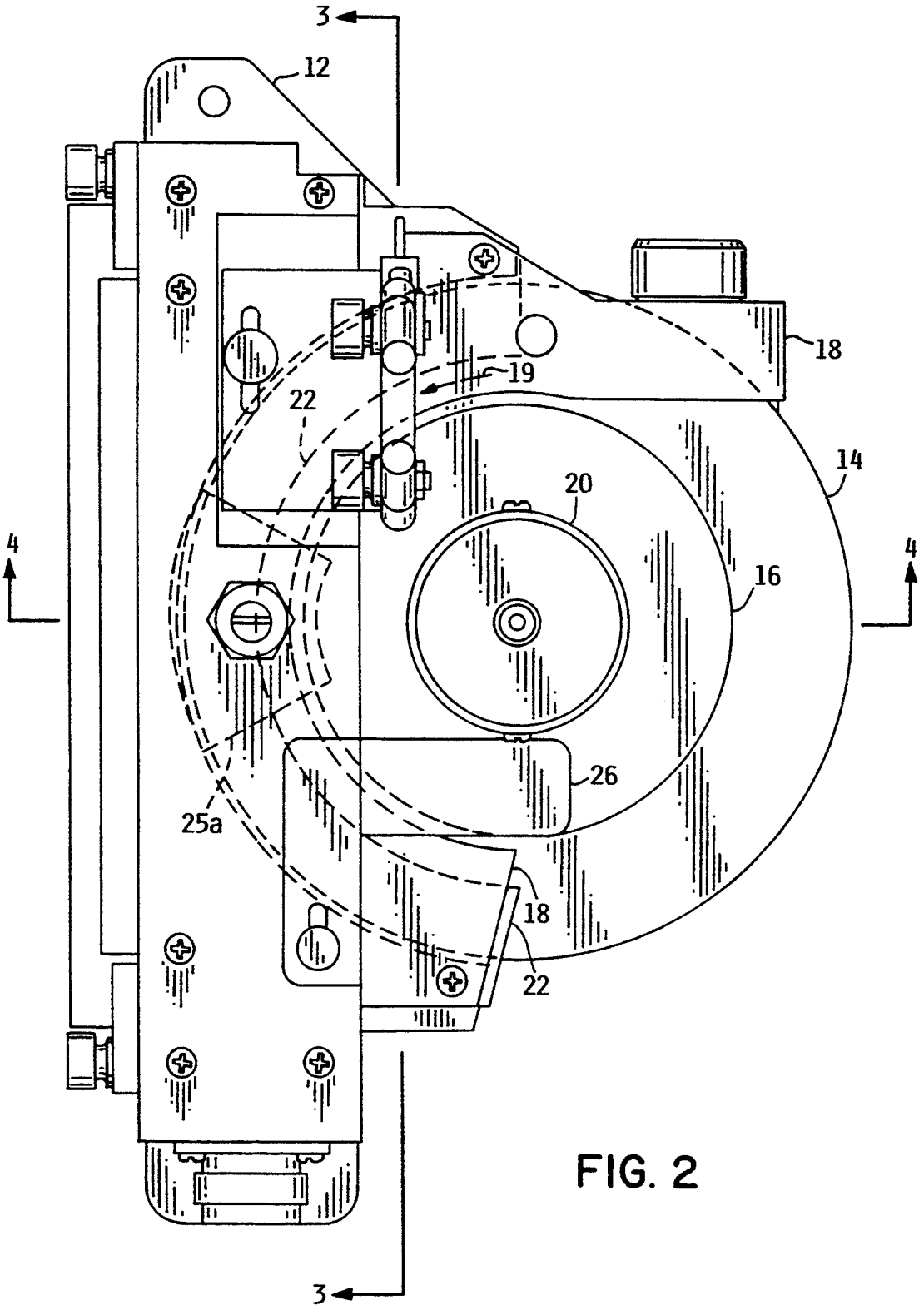
FIG. 2 shows a top view of the invention.

FIG. 2 shows a top view of the machine, illustrating the configuration of the curved guide member 22, the resilient clamp 18, and showing the position of capacitive sensor plate 25*a* in relation to the other components of the machine.

Figure 3:
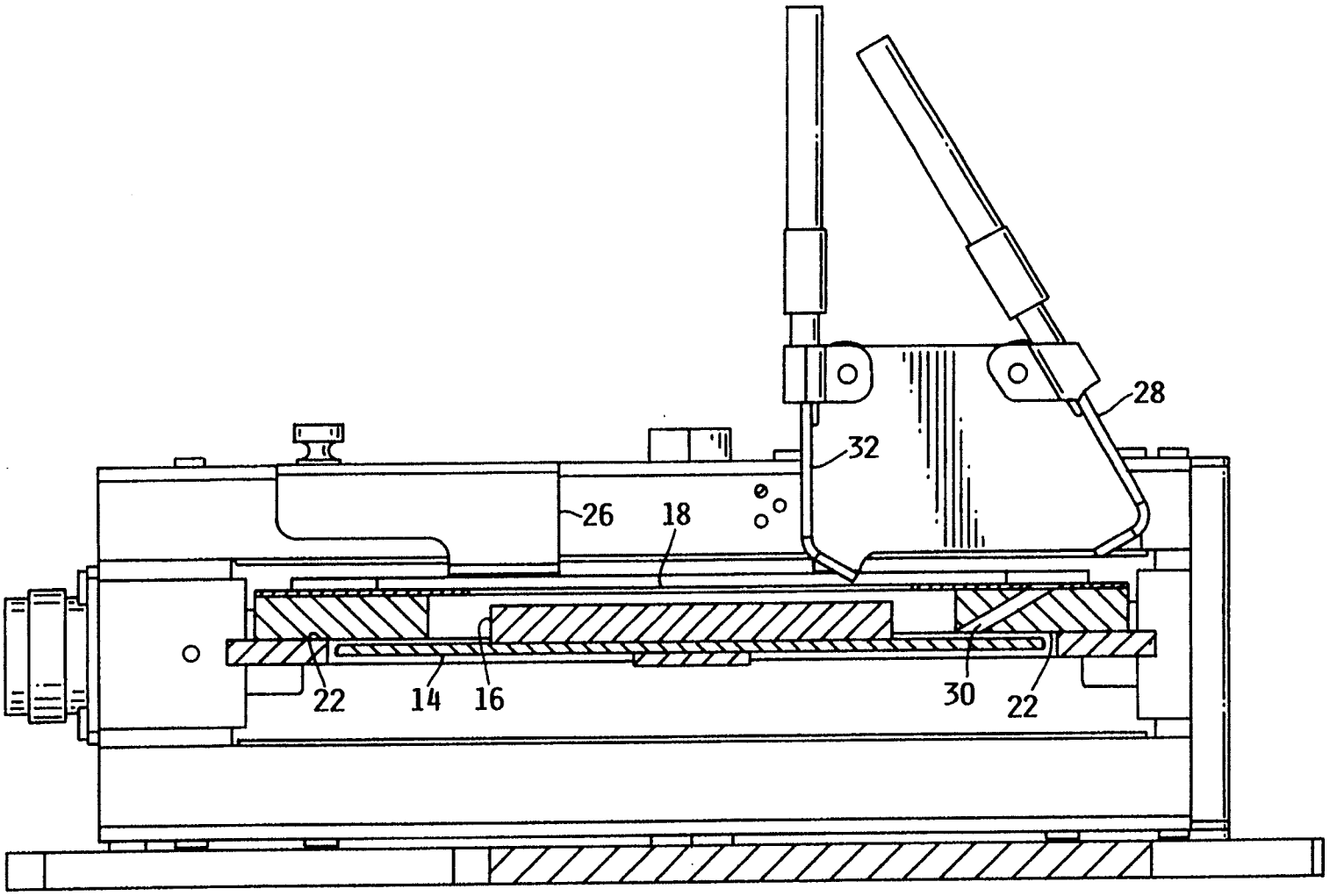
FIG. 3 shows a cross-section view taken along the lines 3—3 of FIG. 2.

FIG. 3 shows a cross-sectional view taken along the lines 3—3 of FIG. 2. This view principally illustrates the positioning of an optical feature of the invention. A fiber optic light guide 28 is connected to a suitable source of illumination (not shown). The light from this source of illumination passes down light guide 28 and is directed through a channel 30 to impinge upon the surface of disk 14. A second fiber optic light guide 32 is connected to a suitable light receiver (not shown), and the end of fiber optic light guide 32 is also directed toward the surface of disk 14. Light passing down the light guide 28 will reflect from the surface of disk 14 to be received by light guide 32 and detected by the detector circuits to which light guide 32 is connected. The respective ends of light guides 28 and 32 are positioned so as to span the entrance channel 19 of disk 14, so that any tablet or tablet particle which is conveyed past the optical light path breaks the light beam and generates an optical signal to the light receiver circuits. The primary purpose of the optical features described herein is to provide a means for sensing small particles which may not be detected by the capacitance sensor. In this case, the optical circuits will detect the passage of a very small particle, the capacitance sensor will not detect the particles, and the optical circuits will generate a signal to control the ejection mechanism so that the small particles will be removed from the path of travel. Secondarily, the optical circuits provide a means for detecting discrete particles which may be closely spaced, and which together may contain sufficient weight so as to be detected by the capacitance sensor. In this case, the optical circuits generate separate signals, each signal representative of a particle, but the particles taken together are measured by the capacitance sensor. The capacitance sensor may determine that the weight is within the specified range of weights acceptable for the tablets, whereas the particles are actually broken pieces of tablets. In such a situation, the optical features detect the small particles by their relative space in time, and if two particles appear too close together they will be ejected by the ejection mechanism controlled by the optical features. Properly conveyed tablets are typically spaced at about 20-30 millisecond intervals, and any particles or tablet pieces which are detected by the optical system to be closer than this spacing in time will be ejected by the aforementioned control circuits.

FIG. 4 shows a cross-sectional view taken along the lines 4—4 of FIG. 2. FIG. 4 particularly shows a cross-sectional view of capacitive sensor 24, illustrating an upper capacitive sensor housing 24*a* and a lower capacitive sensor housing 24*b*. The capacitive sensor is operatively effected between these housings, wherein a predetermined capacitance is measured between capacitive plates 25*a* and 25*b*. If lower disk 14 is rotatably positioned in the capacitive field created between these two plates, the movement of lower disk 14 will create no susceptible change in the measured capacitance between the plates. However, whenever a tablet is conveyed by disk 14 through the capacitive field, the capacitive changes resulting from the physical presence of the tablet result in a measurable capacitance change measured between the plates, and thereby produces an electrical signal. The electrical signal may be analyzed by specialized circuits (not shown) to produce a signal representative of the weight of the tablet. The signal may therefore be compared against a standard or reference signal, to verify that the tablet weight falls within certain predetermined bounds. If the tablet weight falls outside the predetermined bounds the circuitry may activate mechanical controls so as to deflect the tablet from the tablet stream. These features of the invention are the same as described with reference to U.S. Pat. No. 5,135,113, owned by the assignee of the present invention.

Figure 5A:
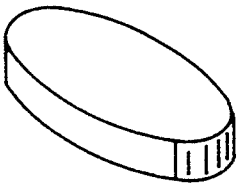
FIGS. 5A and 5B show different views of one form of tablet.
Figure 5B:
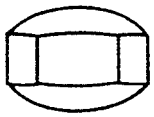
Figure 6A:
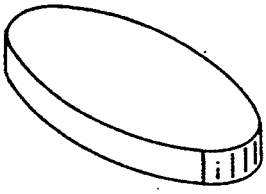
FIGS. 6A and 6B show different views of a second form of tablet.
Figure 6B:
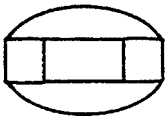
Figure 7A:
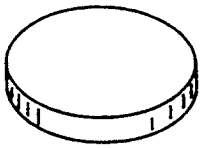
FIGS. 7A and 7B show different views of a third form of tablet.
Figure 7B:
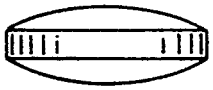
Figure 8A:
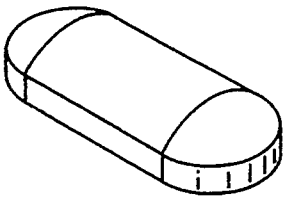
FIGS. 8A and 8B show different views of a fourth form of tablet.
Figure 8B:
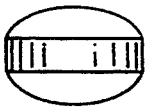
Figure 9A:
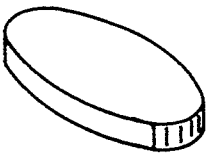
FIGS. 9A and 9B show different views of a fifth form of tablet.
Figure 9B:
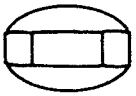
Figure 10A:
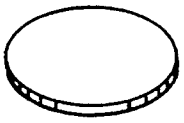
FIGS. 10A and 10B show different views of a sixth form of tablet.
Figure 10B:
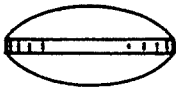
Figure 11A:
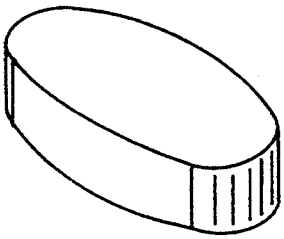
FIGS. 11A and 11B show different views of a seventh form of tablet.
Figure 11B:
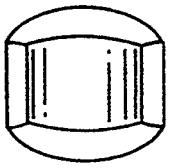
Figure 12A:
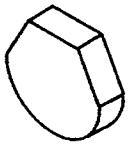
FIGS. 12A and 12B show different views of an eighth form of tablet.
Figure 12B:
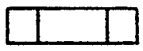
Figure 13A:
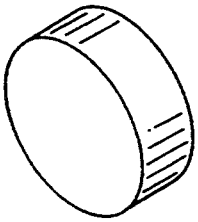
FIGS. 13A and 13B show different views of a ninth form of tablet.
Figure 13B:
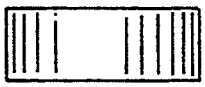
Figure 14A:
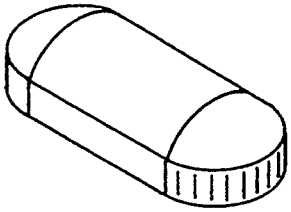
FIGS. 14A and 14B show different views of a tenth form of tablet.
Figure 14B:
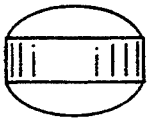
Figure 15A:
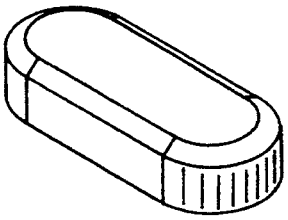
FIGS. 15A and 15B show different views of an eleventh form of tablet.
Figure 15B:
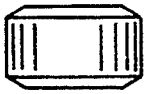

The present invention is useful for conveying and measuring tablets of a wide variety of sizes and shapes. FIGS. 5-15 illustrate many of the different tablet configurations with which the machine is capable of operating. FIG. 5A, for example, illustrates a modified oval tablet, and FIG. 5B shows the tablet to have a curved top and bottom surface. FIGS. 6A and 6B show a similar tablet having slightly different curvatures and sizes. FIGS. 7A and 7B show a circular tablet having curved top and bottom surfaces. FIGS. 8A and 8B show an elongated tablet having uniquely curved top and bottom surfaces and an elongated central section. FIGS. 9A and 9B show yet another form of oval tablet having different curvatures and size characteristics. FIG. 10A and 10B show a different form of circular tablet having a curved top and bottom surface, with a thinner center section. FIGS. 11A and 11B show another form of oval tablet having a relatively thick center section and curved top and bottom surfaces. FIGS. 12A and 12B show an irregular polygon-shaped tablet having flat top and bottom surfaces. FIGS. 13A and 13B show a conventional cylindrical tablet having a round shape and flat top and bottom surfaces. FIGS. 14A and 14B show yet another form of elongated and curved tablet having compound curves and an elongated center section. FIGS. 15A and 15B show a modified form of oval tablet wherein a beveled side surface is provided together with a flat top and bottom surface. The foregoing, and other shapes and sizes of tablets are capable of being handled by the present invention. In some cases, certain channels and dimensions of the invention may be modified in order to handle specific tablets, but the operating principles remain the same for all tablets.

In operation, for each different form of tablet construction, the size dimensions of upper disk 16 are selected so as to provide a channel dimension between upper disk 16 and curved guide 22 which is just large enough to accept the tablet width dimension. The height dimension for mounting resilient clamp 18 is set at 70%–90% of the tablet thickness dimension, and the capacitive sensor is calibrated to the range of capacitive measurements which correspond to the signals produced by a tablet of the selected shape having an acceptable range of weights. The acceptable range of tablet weights may be prestored in an associated processor according to the manner described with reference to U.S. Pat. No. 5,135,113. Tablets are conveyed in a serial stream to the entrance channel 19 which is formed by the respective facing surfaces of upper disk 16 and curved guide 22. The device for feeding the tablets in a serial stream to the aforementioned entrance channel may be a type of device described in the copending patent application referred to herein. As each tablet arrives within entrance channel 19, it resiliently deforms resilient clamp 18 slightly upwardly, so that the tablet is confined within channel 19. The respective edges of the tablet are confined between upper disk 16 and curved guide 22, and the respective top and bottom surfaces of the tablet are clamped by resilient clamp 18 against the upper surface of lower disk 14. The tablets are therefore fixedly confined to uniform orientation, while at the same time being conveyed by disk 14 about a circular path which includes a zone of travel through capacitive sensor 24. During the time interval when the tablet is conveyed through the capacitive sensor 24, an electrical signal is developed by the capacitive sensor 24 which is representative of the weight of the tablet, and this signal is coupled to external processing circuits (not shown) for determining whether the measured tablet weight falls within the range of weights deemed acceptable for the tablet. The tablet is thereafter conveyed through the remainder of the curved path of travel and ultimately exits from the channel. A flipper gating mechanism of the type described in U.S. Pat. No. 5,135,113 may be positioned proximate the exit point, and may be controllable by the processing circuits, to deflect the path of travel of each tablet passing through the channel, so as to direct tablets of acceptable weight along one path of travel and to direct tablets of unacceptable weight along a second path of travel. The activation of the flipper mechanism is controllable so as to be synchronized with the actual tablet position relative to the flipper mechanism; i.e., a tablet which has been sensed by capacitive sensor 24 will arrive at the flipper mechanism a predetermined time later, wherein the flipper mechanism may be actuated to control the further path of travel of the tablet. The time increment is obviously related to the speed of rotation of disk 14, and the speed of rotation must therefore be carefully controlled as a part of the overall operation of the system. It has been found that tablets having a circular cross section behave differently while in the guide channel than tablets having a non-circular cross section; the reason for this difference in behavior is caused by the fact that circular tablets tend to rotate about their axes as they are conveyed by disk 14, the rotation being caused by frictional contact of the edge surface of the tablet against curved guide 22. This affect results in circular tablets traveling through the sensing device at an overall slower rate of speed than non-circular tablets, and therefore it has been found to be necessary to speed up the rate of rotation of disk 14 whenever circular tablets are measured, so as to provide the same relative time increment between the tablet's position under the capacitive sensor relative to its position adjacent the flipper mechanism. The rate of rotation of disk 14 for circular tablets has been determined to be approximately twice the rate of rotation for measuring elongate tablets.

The fiber optic light guides provide essentially a light beam barrier through which all particles must pass as they are conveyed by disk 14. As a passing particle breaks the light beam a signal is generated to appropriate circuits to record the time of passage. This enables the system to correlate the presence of the moving particle with the capacitive sensor measurements made as the particle passes through the capacitive sensor, and also to coordinate the position of the particle relative to the flipper ejection mechanism described in U.S. Pat. No. 5,135,113. Since it is known that the serial tablet feed mechanism feeds tablets onto disk 14 at regular intervals, approximately about every 30 milliseconds, the fiber optic light beam can be used to recognize tablet particles which appear to be more closely spaced than the regular serial feeding mechanism may allow. As to these types of particles, the light beam signal can be coordinated with the flipper ejection mechanism to routinely divert such tablet particles into an ejection bin. Also, if a broken tablet consisting of two pieces fairly closely spaced passes through the light beam, the light beam will record two closely-spaced events, which is considered an abnormal situation. Therefore, even if these two particles are measured by the capacitive sensor as having a tablet weight falling within specification, the light beam signals can be coordinated with the flipper ejection mechanism to automatically reject these tablet particles into the reject bin. In this manner, the light beam and its associated circuits supplement the capacitive measuring system to ensure that only unbroken tablets falling within the predetermined weight specifications are permitted to satisfactorily pass through the tablet sensor device, and to be evaluated as tablets falling within all specifications.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An apparatus for sorting tablets by capacitance measurements, comprising:

a) a rotatable disk having means for rotating at a controllable rate in a substantially horizontal plane;

b) a first conductive plate placed a predetermined distance above said disk, and a second conductive plate placed a predetermined distance below said disk, and means for measuring a capacitance value between said plates, whereby a measured capacitance value with a tablet conveyed between said plates is representative of the weight of said tablet;

c) a first guide assembly placed proximate the periphery of said disk and bridging an arcuate span between said first and second conductive plates, said first guide assembly having an arcuate inner edge formed along a first radius of curvature, said inner arcuate edge forming a guide path at least partially about said disk;

d) a second guide assembly placed on the top surface of said disk and rotatable therewith, said second guide assembly having an outer edge formed along a second radius of curvature smaller than said first radius of curvature, thereby forming a guide channel between said first and second guide assemblies;

e) a resilient planar clamping member affixed to said first guide assembly and extending over said guide channel a predetermined height above said guide channel; and f) means for receiving a sequential stream of tablets into said guide channel, whereby the width of each of said tablets is slightly larger than the difference between said first and second radii of curvature, and the height of each of said tablets is larger than said predetermined height.

2. The apparatus of claim 1, wherein said second guide member is a circular resilient member.

3. The apparatus of claim 2, wherein said clamping member further comprises a first layer having a low coefficient of friction and a second layer having resiliency characteristics, said first and second layers being bonded together.

4. The apparatus of claim 3, wherein said first layer further comprises ultra high density polypropylene material.

5. The apparatus of claim 4, wherein said second layer further comprises polystyrene material.

6. The apparatus of claim 5, wherein said second guide assembly is removably attachable to said first guide assembly.

7. The apparatus of claim 6, further comprising a conductive member resiliently contacting said second guide assembly.

8. The apparatus of claim 5, wherein said clamping member is positioned above said disk a distance which is 70%–90% of the height dimension of a tablet.

9. The apparatus of claim 8, further comprising means for selecting at least two rotational speeds for said disk.

10. The apparatus of claim 9, wherein said disk is constructed of metallic material.

11. The apparatus of claim 1, further comprising a first fiber optic light guide member positioned to direct a light beam into said guide channel in a direction across the entrance of said guide channel.

12. The apparatus of claim 11, further comprising a second fiber optic light guide member positioned to receive said light beam directed across said guide channel.

13. An improvement in apparatus for sorting tablets by capacitance measurements, with a rotatable disk for carrying tablets between the plates of a capacitance sensor, wherein the improvement comprises:

a) a first guide assembly having an inner edge first radius of curvature, said first guide assembly closely spaced above and proximate the periphery of said disk; said inner edge traversing an arc including the plates of said capacitance sensor;

b) a second guide assembly positioned atop said disk and rotatable therewith; said second guide assembly having an outer edge formed about a second radius of curvature, smaller than said first radius of curvature, whereby a tablet channel having a width slightly greater than the width of a tablet to be measured is created between said first and second guide assemblies; and c) a resilient planar clamping member extending at least partially over said tablet channel at a first predetermined height dimension; whereby said height dimension is 70%–90% of the height of a tablet to be measured.

14. The apparatus of claim 13, wherein said second guide member is made from resilient material.

15. The apparatus of claim 14, wherein said resilient planar clamping member further comprises a first layer having a low coefficient of friction and a second layer having resiliency characteristics; said first and second layers being bonded together with said first layer facing said disk.

16. The apparatus of claim 15, wherein said first layer further comprises high density polypropylene material.

17. The apparatus of claim 16, wherein said second layer further comprises polystyrene material.

18. The apparatus of claim 14, further comprising a conductive member resiliently contacting said second guide assembly, whereby to discharge static electricity from said second guide assembly.

19. The apparatus of claim 18, wherein said second guide assembly is removably attachable to said disk.

20. The apparatus of claim 19, wherein said disk is constructed of metallic material.

* * * * *